US006402010B1

(12) United States Patent
Virginio et al.

(10) Patent No.: US 6,402,010 B1
(45) Date of Patent: Jun. 11, 2002

(54) METHOD AND PLANT FOR THE ROLLING OF A CONTINUOUS BILLET FED FROM A BILLET-HEATING FURNACE SET UPSTREAM OF A ROLL TRAIN

(75) Inventors: Pometto Virginio, Milan; Gianfranco Mantovan, Varese, both of (IT)

(73) Assignee: Techint Compagnia Tecnica Internazionale S.p.A., Milan (IT)

( * ) Notice: Subject to any disclaimer, the term of this patent is extended or adjusted under 35 U.S.C. 154(b) by 0 days.

(21) Appl. No.: 09/604,212

(22) Filed: Jun. 27, 2000

(30) Foreign Application Priority Data

Jun. 30, 1999 (IT) ..... MI99A1438

(51) Int. Cl.[7] ..... B23K 37/00; B21B 1/24

(52) U.S. Cl. ..... 228/158; 228/5.7

(58) Field of Search ..... 228/158, 155, 228/164, 170, 171, 212, 5.7, 13, 15.1, 44.3, 47.1; 219/610, 611, 617, 614, 57, 97, 99, 101, 107; 72/202, 342.1; 29/336

(56) References Cited

U.S. PATENT DOCUMENTS 4,018,376 A * 4/1977 Capetti
4,846,254 A * 7/1989 Kimura
4,854,493 A * 8/1989 Fujii et al.
5,121,873 A * 6/1992 Sekiya et al.
5,172,846 A * 12/1992 Hayashi et al.
5,292,052 A * 3/1994 Ito et al.
5,461,770 A * 10/1995 Kimura et al.
5,490,315 A * 2/1996 Kostopolos et al.
5,709,585 A * 1/1998 Matsuo et al.
5,719,368 A * 2/1998 Okushima et al.
5,774,973 A * 7/1998 Aoyama et al.
5,787,565 A * 8/1998 Matsuo et al.
5,829,117 A * 11/1998 Okawa et al.
5,884,832 A * 3/1999 Funamoto et al.
5,931,370 A * 8/1999 Poloni et al.
5,957,367 A * 9/1999 Matsuo et al.
5,994,665 A * 11/1999 Nishibayashi et al.
6,041,993 A * 3/2000 Matsuo et al.
6,089,441 A * 7/2000 Matsuo et al.
6,116,496 A * 9/2000 Matsuo et al.
6,189,763 B1 * 2/2001 Tazoe et al.
6,213,381 B1 * 4/2001 Funamoto et al.

FOREIGN PATENT DOCUMENTS

EP 0806254 * 11/1997
EP 0832700 * 4/1998
JP 53135863 * 11/1978

* cited by examiner

*Primary Examiner*—Tom Dunn
*Assistant Examiner*—Colleen P. Cooke
(74) *Attorney, Agent, or Firm*—Hedman & Costigan, P.C.

(57) ABSTRACT

The invention regards a method for rolling a continuous billet (15) fed from a billet-heating furnace (10) set upstream of a roll train, in which, between the furnace (10) and a first stand (11) of the roll train is provided an operation of welding, during, billet movement, of the head of each billet (14), which has come out of the furnace (10) along an axis (12) of exit from the furnace, to the tail of the billet (15) being rolled, which is proceeding along a rolling axis (13). The aforesaid welding operation is carried out along the rolling axis (13) which is staggered with respect to the axis (12) of exit from the furnace.

5 Claims, 8 Drawing Sheets

Figure 1:
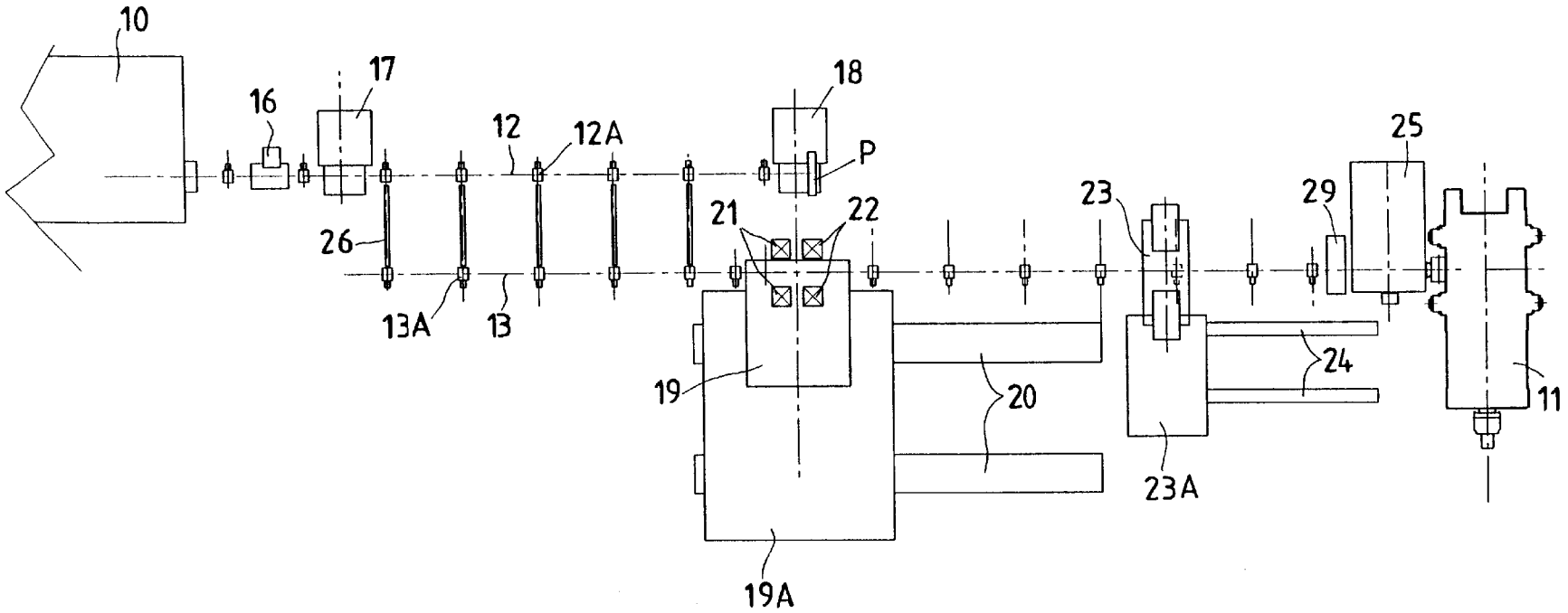

METHOD AND PLANT FOR THE ROLLING OF A CONTINUOUS BILLET FED FROM A BILLET-HEATING FURNACE SET UPSTREAM OF A ROLL TRAIN

The present invention refers to a method for rolling a continuous billet fed from a billet-heating furnace set upstream of a roll train, of the type in which, between the furnace and the first stand of the roll train, welding is envisaged, in moving conditions, of the head of each billet sent out of the furnace to the tail of the continuous billet being rolled.

The invention also refers to a plant which is particularly suitable for the implementation of said method.

The persons skilled in the branch are well acquainted with the methods for rolling a continuous billet that has come out of a billet-heating furnace which is aligned with a roll train.

All the aforesaid methods set themselves the same aim, namely that of increasing productivity of the rolling mill, at the same time obtaining a high-quality final product.

Methods for rolling a continuous billet of the type generically indicated above are, for instance, described in the patents EP-0761330 and EP-0832700, to which the reader is referred if further clarifications were necessary.

In brief, EP-0,761,330 regards a continuous rolling method comprising the steps of: moving simultaneously a mobile flash butt-welding machine and a deburring machine, which can be moved separately during welding; carrying out butt welding while the welding machine and the deburring machine are moving along a pre-set welding path; moving the deburring machine backwards together with the welding machine to meet the welded part, and bringing the welding machine backwards into a waiting position, after completion of welding; and removing the burrs from the welded part while the deburring machine is changing the direction of its travel and is moving according to a specific path after the welded part has reached a pre-determined position.

EP-0,761,330 also refers to a plant for implementation of the method described above, comprising: a rotary table which connects the axis of a continuous casting upstream to a rolling axis downstream, and which transfers the billets that have come out of the furnace upstream of the rotary table along the rolling axis; a descaling device for removing the scale from the billets; a mobile flash butt-welding machine which continuously joins a rear end (tail) of the previous billet to a front end (head) of the subsequent billet by means of flash butt-welding; a mobile deburring device which removes the burrs from the welded part of the billets by means of a grinder; and an induction heater which heats a continuously joined billet. EP-0,832,700 regards both a process for welding billets coming out of a furnace, and a plant for rolling billets that adopts the said welding process.

More precisely, EP-0,832,700 described a welding process for billets coming out of a heating furnace along an axis coinciding with the rolling axis, where, in the stretch between the heating furnace and the first rolling stand, a precise layout of operating units is envisaged. The following are in fact provided: at least one feeding device, a roller way for conveying billets, a mobile welding unit equipped with welding yokes, and an emergency billet shear.

In one first step of the process, the tail of the billet being rolled is welded to the head of the billet that has come out of the furnace, and this welding operation is carried out on the two billets, while these are moving, by a welding unit, which is mounted on a mobile trolley.

According to the invention that forms the subject of EP-0,832,700, the mobile trolley, which carries the welding unit, in one first stationary waiting condition, provides for the two ends of the billets to be joined coming into contact; next, the trolley, as it advances, accelerates to the rolling speed, and in this condition welding of the. ends of the billets takes place. Finally, there is a backing-off step in which the trolley returns to the starting position.

A further characteristic of the process according to EP-0,832,700 regards welding of the ends of the billets, which is preceded by a descaling step and a shearing step, while the billets are moving, in which the two ends of the billets set against one another for welding are sheared. The latter step is carried out by means of a shearing unit set on board the mobile trolley, upstream of the welding unit.

Another characteristic is that the welding step is followed by a deburring step, also performed in moving conditions by a deburring machine unit.

Processes and plants for welding billets are described and illustrated also in the patents DE 28 36 338 and U.S. Pat. No. 2,214,618.

DE 28 36 338 refers to a welding process in which a mobile trolley is present that follows the billets to be joined, before the subsequent processing.

According to the two embodiments that are illustrated in the above patent, the mobile trolley may be placed either directly downstream of the furnace, or immediately upstream of the rolling stands.

DE 28 36 338 does not provide any indication as regards treatment of the ends of the billets that are to be welded together.

U.S. Pat No. 2,214,618 (which regards the welding of coils) envisages a trolley carrying a shearing element, a welding element, and a grinding element for grinding the portion welded. In addition, it is specified that welding between the tail of the strip of the first coil and the head of the strip of the second coil is carried out in moving conditions, without stopping the rolling plant.

The general purpose of the present invention is to propose a method and corresponding plant for rolling a continuous billet—formed by mutual welding of a plurality of billets that have come out of a billet-heating furnace—which will ensure advantages with respect to the known methods.

The above purpose is achieved by a method and plant having the characteristics specified in the attached claims.

Figure 6:
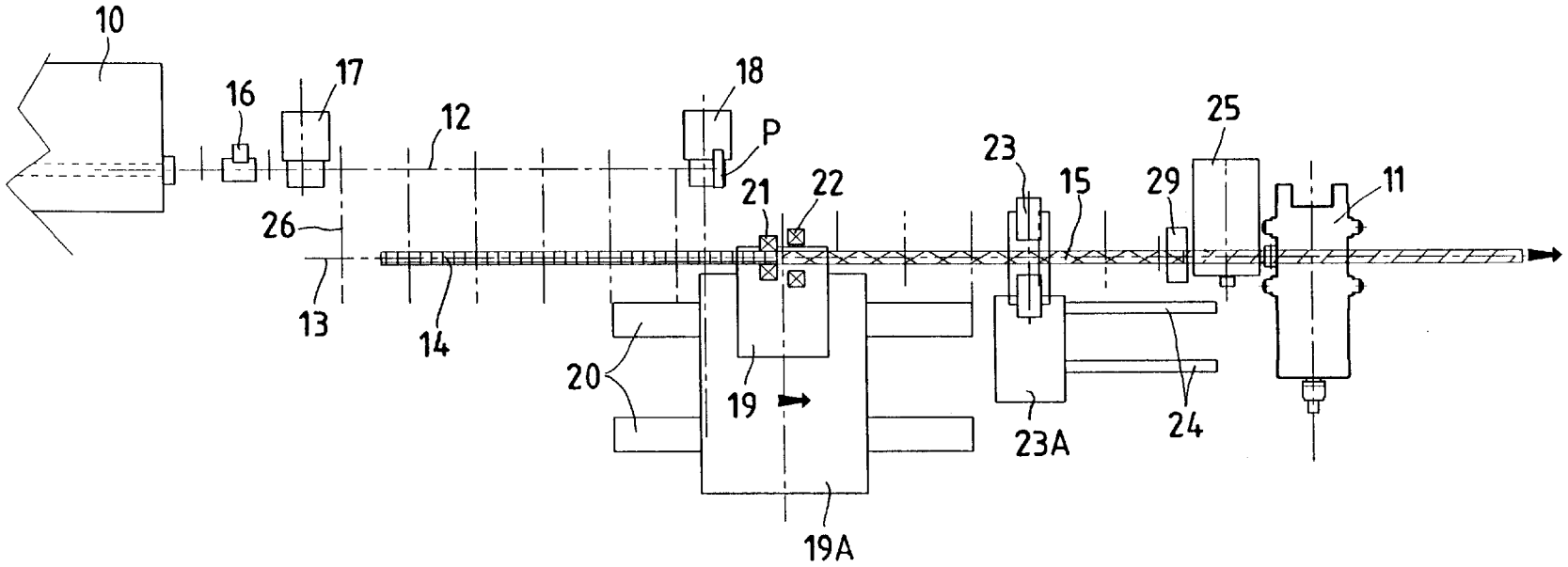
Figure 7:
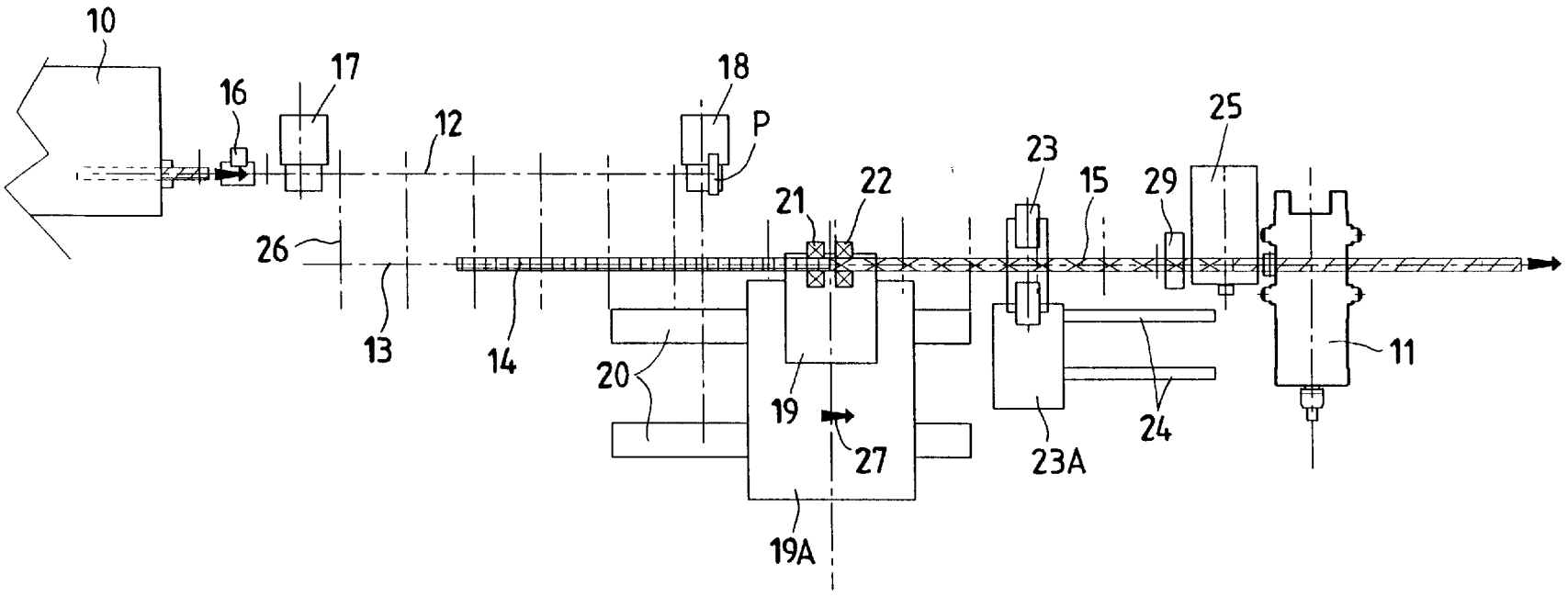
Figure 8:
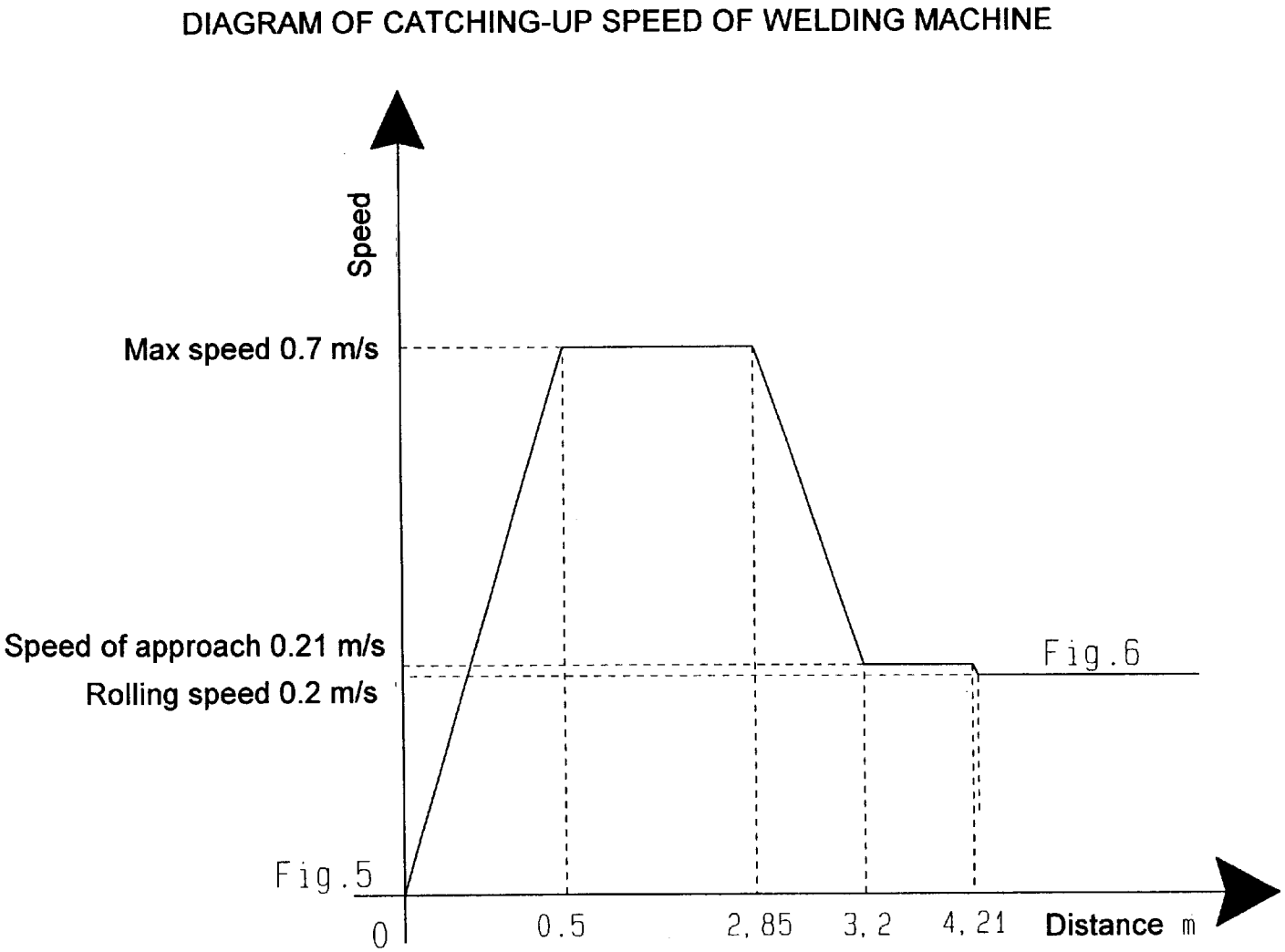

The structural and functional characteristics of the present invention, as well as its advantages as compared to the prior art, will emerge even more clearly and evidently from an examination of the ensuing description referring to the attached schematic drawings, which show a possible example of implementation of the new and original ideas of the present invention. In the drawings:

FIG. 1 is a schematic plan view illustrating a plant suitable for the implementation of the method according to the invention; and FIGS. 2–7 are views illustrating the plant of FIG. 1 in the succession of the various operating steps of the rolling method according to the invention; and FIG. 8 is a speed/distance diagram illustrating the behaviour of the welding machine, in the critical phase preceding welding, according to a possible example of practical implementation of the method of the present invention.

In FIG. 1 of the drawings, a billet-heating furnace is designated by 10, and the first stand of a roll train is designated by 11. The reference number 12 designates the axis of exit of the billets from the furnace, and 13 the axis of rolling.

As may be clearly seen in the schematic drawings, according to a characteristic of the invention the said axes 12, 13 are staggered by a desired amount and are parallel to one another.

The furnace 10 and the first stand 11 of the roll train are set apart by a distance whereby it is possible—in the time interval identified—to carry out welding. of the head of a billet 14 that has come out of the furnace 10 to the tail of a continuous billet 15 that is undergoing rolling.

Welding of the head of the billet 14 to the tail of the billet 15 is performed by means of a series of operating units cascaded between the furnace 10 and the stand 11, according to a layout and to operating procedures that are innovative as compared to the known art.

More precisely, set downstream of the furnace 10 are in succession a descaler 16, a pair of interspaced cropping devices 17, 18, a mobile welding machine 19, which is mounted for this purpose on a trolley 19A that can be translated forwards and backwards on rails 20, said welding machine 19 being provided with two pairs of welding yokes 21, 22 set opposite to each other, respectively upstream and downstream, a mobile deburring machine 23, also mounted on a trolley 23A, which can be translated forwards and backwards on rails 24, and a possible emergency billet shear 25.

Upstream of the emergency billet shear 25, if necessary a billet-heating system 29 may be provided, such as an induction coil or a burner furnace.

Since the above-mentioned operating units can be of any type well known to the persons skilled in the branch, they are not described in greater detail herein. As has already been said, FIGS. 2–7 illustrate the sequence of the operating steps of the method according to the invention, which envisages welding of the head of the billet 14 coming out of the furnace to the tail of the billet 15 undergoing rolling in a way which is different and innovative as compared to the techniques up to now adopted.

Figure 2:
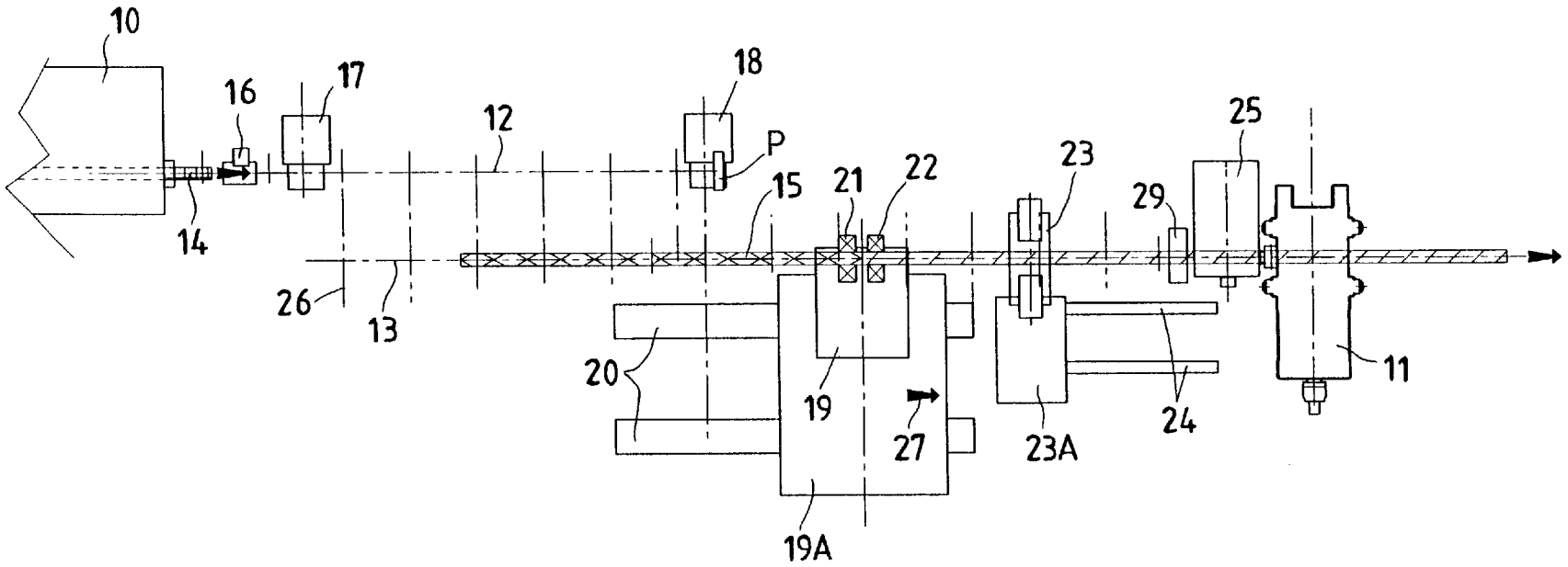

More precisely, while the continuous billet 15 is being rolled along the rolling axis 13, the billet 14 comes out of the furnace along an, axis 12 of exit from the furnace, which is different from the rolling axis 13 (FIG. 2).

Along the axes 12, 13, respective motor-driven and/or idle roller ways 12A, 13A are provided which send the billets on.

Figure 3:
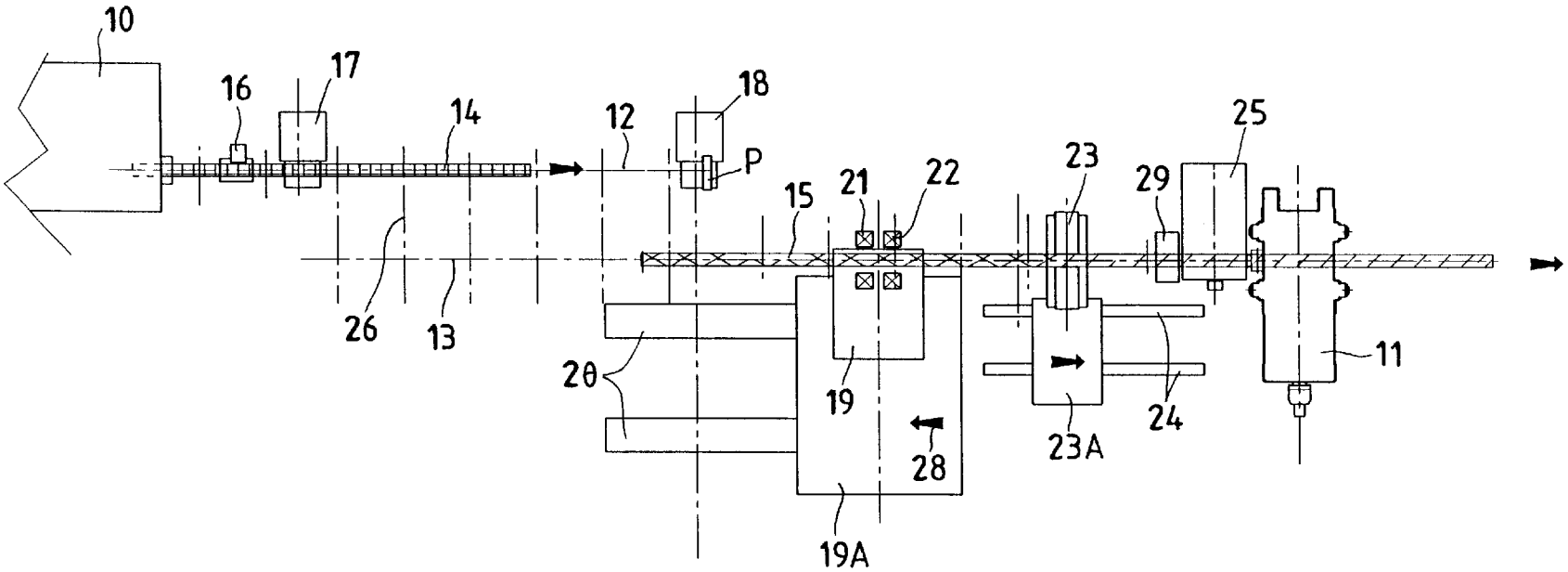
Figure 4:
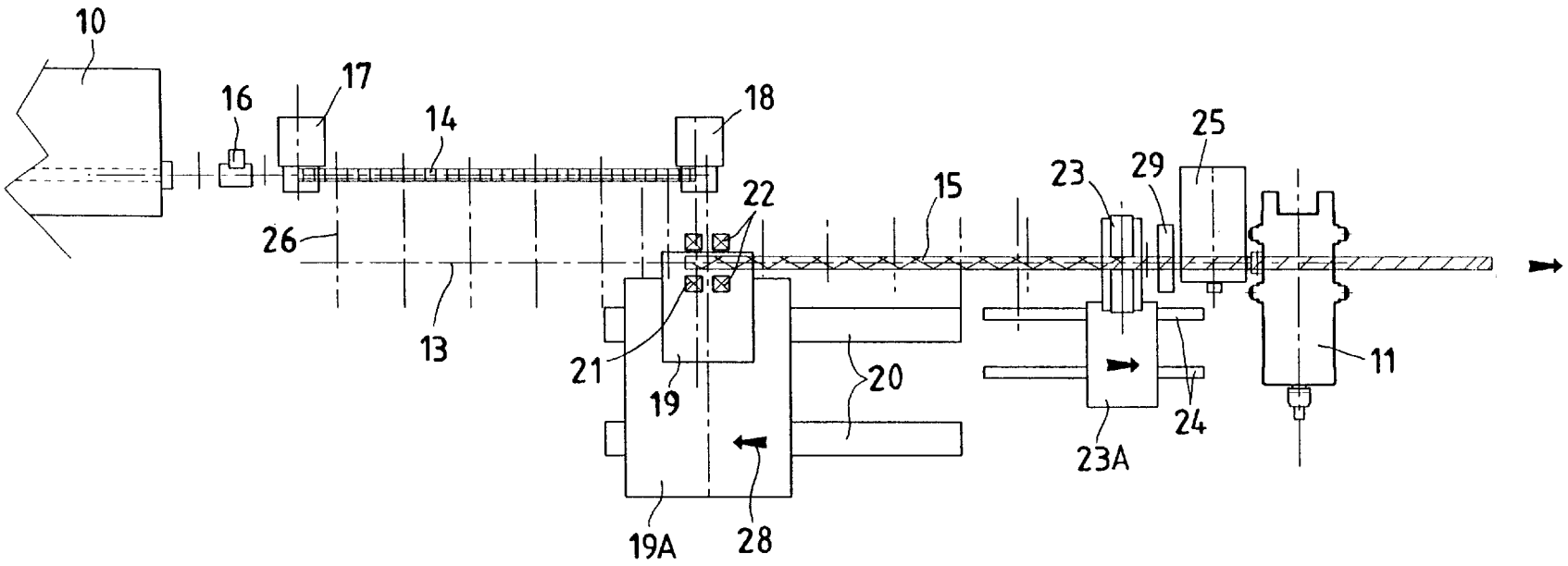

As is shown in FIGS. 3 and 4, the billets 14, 15 are made to advance at different speeds (higher for the billet 14 that has come out of the furnace, lower for the continuous billet 15 undergoing rolling).

Again with reference to FIG. 4, when the continuous billet 15 is leaving the area of influence of the open yokes 21, 22, the billet 14 is stopped, by means of a barrier P, with its head and tail set in points corresponding to the cropping devices 17, 18, which perform simultaneous cropping of the head and tail.

Figure 5:
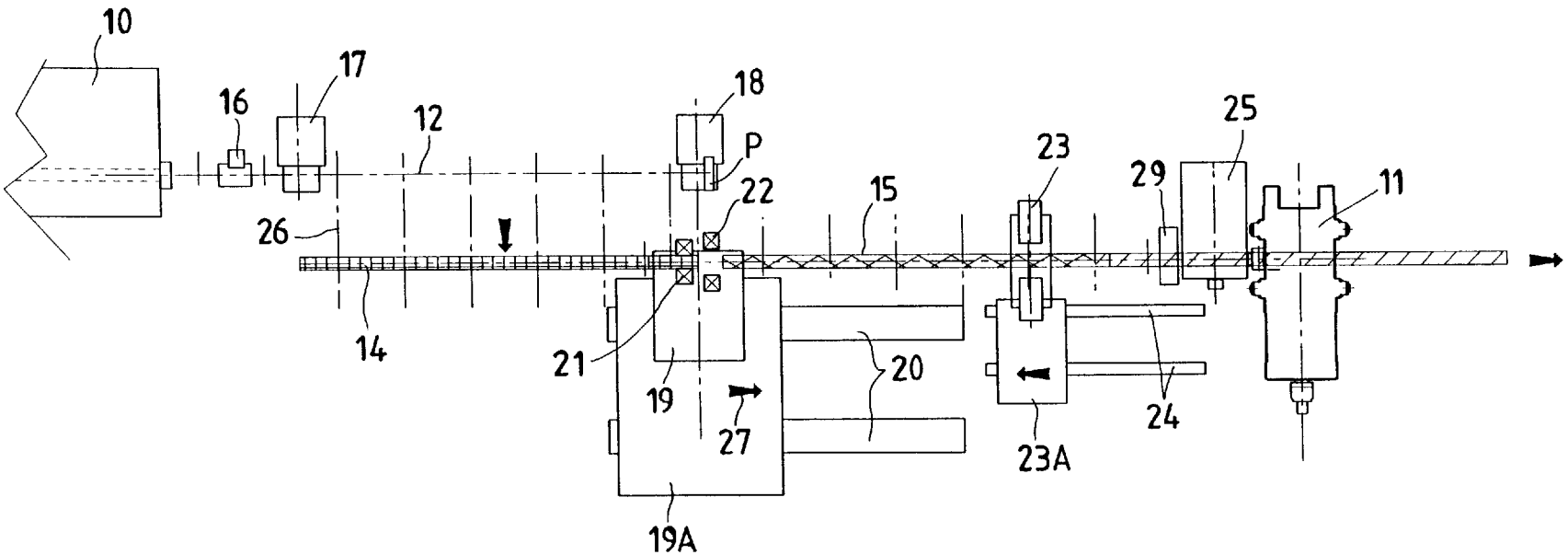

The cropped billet 14 is transferred, by any type of conveyor illustrated schematically in 26, from the axis 12 of exit of the billets from the furnace to the rolling axis 13, and its head is gripped by the pair of yokes upstream 21, whilst the yokes of the pair downstream 22 still remain open (FIG. 5).

When the billet 14 is in this condition, the welding, machine 19 (carried by the mobile trolley 19A) starts. its translation in the direction of the arrow 27 (FIG. 5) so as to cause the head of the billet 14 to catch up with the tail of the continuous billet 15, until the two billets are brought into contact with one another (FIG. 6).

When the said head and tail are in contact, as shown in FIG. 6, the pair of yokes downstream 22 of the welding machine 19 closes on the tail of the continuous billet 15, and welding of said head and tail together is carried out in moving conditions (FIG. 7).

The welded area is deburred, in moving conditions, by the deburring machine 23, as shown in FIGS. 3 and 4, which, for this deburring operation, evidently refer to the previous operating step, whilst FIG. 5 shows the return of the same deburring machine 23 into the starting position, where it is ready for the start of a new operating cycle.

The operating cycle described above with reference to FIGS. 2–7 terminates as shown in FIG. 2, and at the same time a new operating cycle starts with the next billet coming out of the furnace.

The diagram, provided as an example, of FIG. 8 refers to the operating step illustrated in FIGS. 5 and 6. In this diagram it may be seen how the welding machine 19, from a stationary condition, undergoes an abrupt acceleration from a speed of 0 m/sec to a speed of approximately 0.7 m/sec so as to bring the head of the billet 14 that has come out of the furnace up close to the tail of the continuous billet 15 being rolled. The billet 14 proceeds, at the said speed of approximately 0.7 m/sec, -until it reaches an area where it undergoes an abrupt deceleration from approximately 0.7 m/sec to approximately 0.21 m/sec and where the said head and tail are almost in contact with one another.

The contact proper takes place gently, following upon a further deceleration from approximately 0.21 m/sec to approximately 0.20 m/sec, so as to enable the welding operation illustrated in FIGS. 7, 2.

The advantages of the method and plant according to the invention are summarized below.

First of all, it should be pointed out that the plant according to the invention is provided with two roller ways which are set at a distance apart and are parallel to one another, whilst known plants are provided with a single roller way, the axis of which coincides with the axes of exit of the billets from the furnace and of rolling.

According to. the invention, the two roller, ways are interconnected by a conveyor means which enables translation of the billet along an axis perpendicular to the axis of exit of the billets from the furnace. As a result, in the system according to the invention, there is a relative positioning between the head of the billet that has come of the furnace and the yokes of the welding machine (stationary in the waiting position) which is precise and reliable.

The provision of two roller ways that are set at a distance apart and parallel to one another moreover makes it possible to render the operations of sending the billets out of the furnace independent of the welding and rolling operations. It is thus possible to carry out operations, such as descaling of the billets or preparation of the ends to be welded, "in the shade", i.e., independently of the welding and rolling process, with a noticeable reduction in the cycle times.

In addition, in the event of accidents or loss of the rhythm of production, the double roller way enables temporary storage, away from the rolling axis, of the last billet that has come out of the furnace, with a consequent greater flexibility and ease of management of the rolling line. In fact, the operations upstream of the rolling line are independent of the ones downstream.

Finally, the presence of a special device for removing from the line the billets that have come out of the furnace in the event of an accident and/or malfunctioning downstream is not required.

Another important difference is represented by the fact that, in the system according to the invention, the mobile welding machine is in the waiting position for a purpose different from that of the system of EP-0,832,700, which refers to the position of head-to-tail contact.

According to the system of the invention, the welding machine is in the waiting position for transverse transfer of the billet (stopped by a barrier) from one roller way to the other, so as to be gripped in an extremely precise position by the yokes of the welding machine that are set upstream.

In addition, according to the invention, the trolley with the billet gripped by the yokes of the welding machine starts at a speed higher than the rolling speed, as it catches up with the continuous billet, and in the vicinity of the latter (head and tail almost in contact) slows down until it reaches the rolling speed, so guaranteeing a gentle meeting-up of the two surfaces facing one another, which is conceptually different from the system of EP-0,832,700.

According to the method of the invention, the two end faces are cropped.

The step of cropping of the head and tail of the billets is performed during the step of welding of the previous billet, away from the rolling axis, so reducing the length of the line and preventing any danger of jamming of the separated lengths.

In this way, the purpose mentioned in the preamble of the description is achieved.

The scope of the invention is defined by the ensuing claims.

What is claimed is:

1. A rolling plant for rolling a continuous billet (15) fed from a billet-heating furnace (10) set upstream of a roll train, in which in the space between the furnace (10) and a first stand (11) of the roll train is provided a system of welding the head of a first billet (14) coming out of the furnace (10) along an axis (12) of exit from the furnace to the tail of a second continuous billet (15) that is undergoing rolling along a rolling axis (13), characterized in that said system comprises downstream of said furnace (1), in combination and succession:

(a) a descaler (16), a pair of interspaced cropping devices (17, 18);

(b) a mobile welding machine (19) mounted on a trolley (19A), which can be translated forwards and backwards on rails (20), and provided with two pairs of yokes (21, 22) set opposite to one another, respectively upstream and downstream relative to one another;

(c) a mobile deburring machine (23), said descaler (16) being provided along the axis (12) of exit of the billets from the furnace (10), whilst the welding machine (19) and the deburring machine (23) are provided along the rolling axis (13) which is interspaced and parallel to the axes (12, 13); and (d) a translator (26) for the billets (14) coming out of the furnace (10).

2. A plant according to claim 1, wherein upstream of the first stand (11) is provided an emergency shear (25).

3. A plant according to claim 1, wherein said interspaced cropping devices (17, 18) are provided along the axis (12) of exit of the billets (14) from the furnace (10).

4. A plant according to claim 1, wherein said interspaced cropping devices (17, 18) are provided at the sides of the translator (26).

5. A plant according to claim 2, wherein a heating system (29) for rendering the temperature of the billet uniform prior to its being fed into the first stand (11) is positioned upstream of an emergency shear (25).

* * * * *